US007491114B2

(12) United States Patent
Zhang et al.

(10) Patent No.: US 7,491,114 B2
(45) Date of Patent: Feb. 17, 2009

(54) FIBER OPTIC POLISHER

(76) Inventors: Hong Zhang, 505 Aspen Dr., Plainsboro, NJ (US) 08536; Boying B. Zhang, 10 Stonicker Dr., Plainsboro, NJ (US) 08648

( * ) Notice: Subject to any disclaimer, the term of this patent is extended or adjusted under 35 U.S.C. 154(b) by 0 days.

(21) Appl. No.: 11/600,774

(22) Filed: Nov. 17, 2006

(65) Prior Publication Data

US 2008/0119111 A1 May 22, 2008

(51) Int. Cl.
*B24B 7/24* (2006.01)

(52) U.S. Cl. ..... 451/11; 451/42; 451/357

(58) Field of Classification Search ..... 451/11, 451/5, 8, 10, 364, 384, 42, 270, 271, 357, 451/359

See application file for complete search history.

(56) References Cited

U.S. PATENT DOCUMENTS 4,291,502 A * 9/1981 Grimsby et al. ..... 451/271
4,831,784 A * 5/1989 Takahashi ..... 451/288
4,979,334 A * 12/1990 Takahashi ..... 451/271
5,265,381 A * 11/1993 Takahashi ..... 451/41
5,516,328 A * 5/1996 Kawada ..... 451/259
6,190,239 B1 * 2/2001 Buzzetti ..... 451/42
6,471,570 B1 * 10/2002 Minami et al. ..... 451/271
6,736,702 B2 * 5/2004 Minami ..... 451/8
6,830,501 B2 * 12/2004 Minami et al. ..... 451/41

* cited by examiner

*Primary Examiner*—Robert Rose

(57) ABSTRACT

A fiber optic polishing apparatus is disclosed including a single degree-of-freedom (DOF) gear transmission system, a pressurizing module, a fixture module, and a housing assembly motorized polisher. The single DOF gear transmission system would enable a fiber optic polishing machine, or polisher to be driven by only one motor, or by human hand. The manual polisher is a unique field polishing machine where electricity or battery is not available or not allowed. Both manual polisher and motorized polisher have the following features: polishing up to four connectors or ferrules simultaneously; adjustable force ensures consistent finish for a wide variety of connector types and the number of connectors in the fixture; quick release for convenient removal of polish fixture; low center of gravity for high stability; small footprint for multiple-machine operation to avoid time-consuming film change.

18 Claims, 7 Drawing Sheets

FIBER OPTIC POLISHER

BACKGROUND OF THE INVENTION

1. Field of the Invention

The invention is related to a fiber optical polishing machine to polish end surfaces of optical fibers secured in ferrules, or the connection end surfaces of optical connectors with high polishing quality.

2. Description of Related Art

Unlike electrical wires, optical fibers require end-surface treatment for proper light propagation. The two most common ways of end surface preparations are cleaving and polishing, in which polishing is essential and key process for almost all glass-based fibers with cladding diameters larger than 200 microns. Furthermore, polishing is required for all fiber connectors used in optical communication to get smaller insertion loss and higher return loss. Because the diameter of most optical fibers ranges from 80 um to 1000 um, too small to be polished directly, ceramic, metal, or glass ferrules are often used to protect the fibers. The most commonly used fiber connectors employ ceramic or metal ferrules. Glass ferrules are preferred when optical coating is necessary after polishing for better adhesion. Unlike lens polishing, the convex surfaces of the fiber ferrules are achieved by pressing the ferrules on flexible polishing pads. The domed surface is ideal for true physical contact between two single mode fiber cores. Physical contact is also possible with multimode fibers when the core diameter is small. The dome radius of curvature is determined by the polishing locus (movement path), pressing force, the hardness and the thickness of the polishing pad. A true physical contact also requires a slight undercut of the fiber. The amount of undercut is the result of the type of polishing film used, polishing locus, the force applied, and the polishing speed. As one can imagine, a consistent high-quality and high speed polish can only be achieved by a polishing machine with a well designed polishing locus.

U.S. Pat. No. 6,190,239 illustrates a polishing method using two stage members to create and maintain a figure eight polishing path pattern for polishing machine. The specific embodiment disclosed includes two server motors, motor drivers and a computer program that controls the method.

U.S. Pat. No. 4,831,784 discloses an apparatus for fiber polishing machine. The fibers are mounted on a jig so that their end faces are pressed against a polishing film attached to a rotary disk. The jig performs an orbital motion while describing a relatively small circle, and the polishing disc is turned in a large circle. The polishing path pattern is a cycloid curve. However, the device is not without its problems. That is, since its polishing disc only turns around on its axis and the component supporting the optical fiber makes a movement corresponding to the revolution, the polishing quality fluctuates depending on the mounting position of the optical fiber. Besides, fiber movement during polishing process is not allowed for larger quantity fiber polishing.

Another U.S. Pat. No. 4,979,334 by Takahashi, discloses a polishing disk, supporting a polishing medium, wherein the polishing disk is made to rotate around its own axis while revolving about another axis by a rotating motor, a revolving motor and a complex mechanical mechanism. While this machine produces a better polishing effect by the combined rotating and revolving motion, but one of the drawback is to use two electric motors.

U.S. Pat. No. 6,736,702 developed a more complex gear transmission system realizing the similar polishing trace as U.S. Pat. No. 4,979,334. But it still requires two electric motors to drive the polishing machine.

In some applications of fiber communication such as oil and gas field, where electrical and other powers are not allowed for fire prevention, a manual fiber optic polisher is the only option. In other outdoor applications, where power is not available and/or battery is depleted, a manual polisher comes in extremely handy. However, the prior arts, or the existing fiber optic polishing machine on the market can not be turned into a manual polisher because they all require two motors for driving. In other words, their mechanical transmission systems have two degree-of-freedom (DOF).

SUMMARY OF THE INVENTION

In order to solve the aforementioned problem, the first object of the present invention is to provide a single DOF gear transmission system for fiber optic polishing machine so that a fiber optic polishing machine can be driven by only one motor, or by human hand.

Another object of the present invention is to provide a portable fiber optic hand polisher, manual polisher, for field use, or outdoor use, such as oil field, where electric power is not allowed, or not available.

A further object of the present invention is to provide one-to-four position fiber optic desktop polisher for small scale production and R&D environment.

DETAILED DESCRIPTION OF THE INVENTION

The present invention is now described in detail with reference to the accompanying drawings for particular applications. However, the present invention is not limited thereto.

One DOF Gear Transmission System

Figure 2:
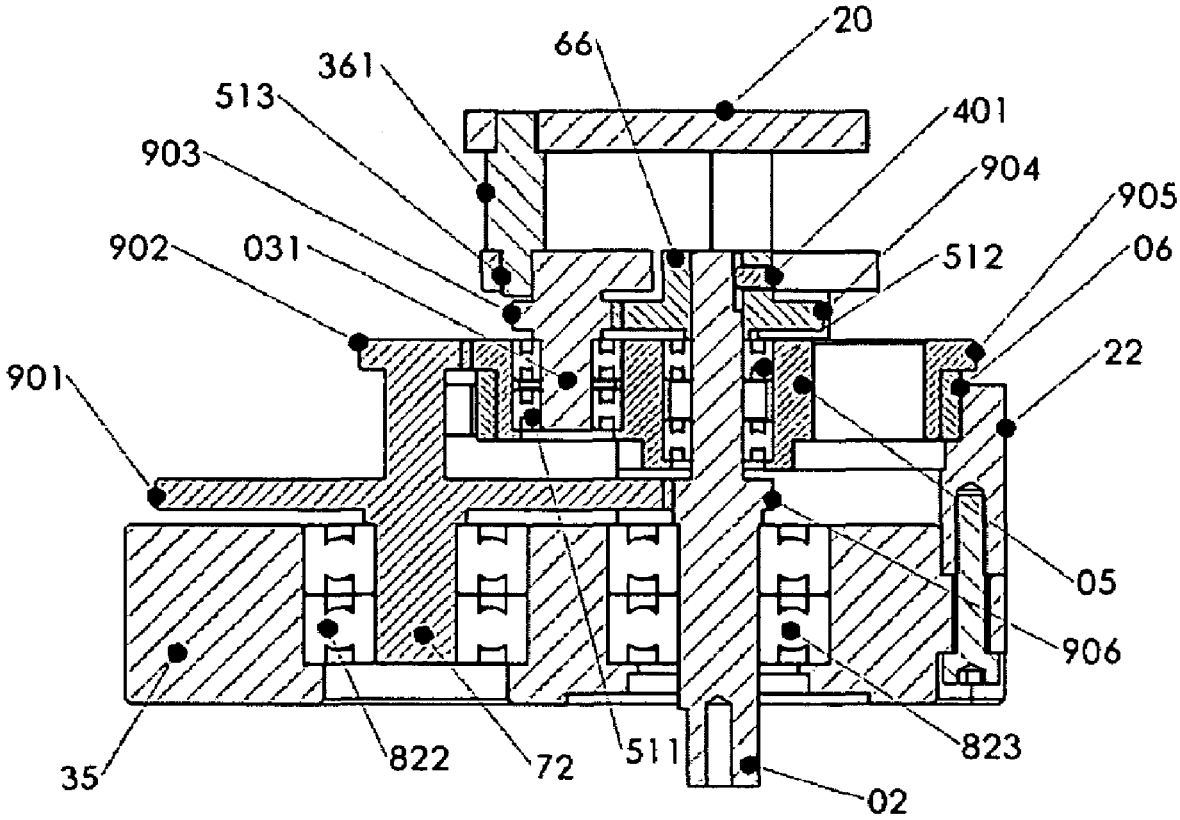
FIG. 2 is a cross section view of the one DOF gear transmission system in the invention.
Figure 3:
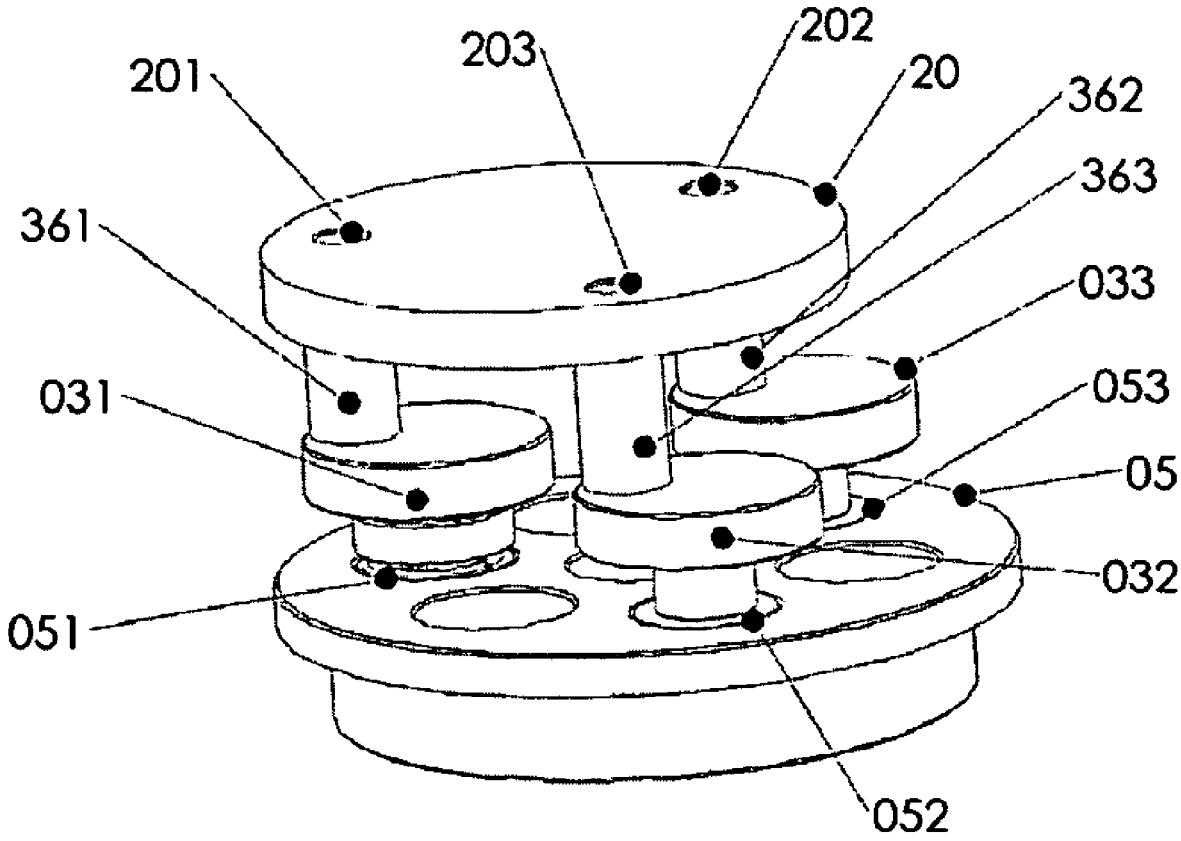
FIG. 3 is a 3D view of the turn table driving mechanism illustrating the principle of the turn table movement in the invention.
Figure 4:
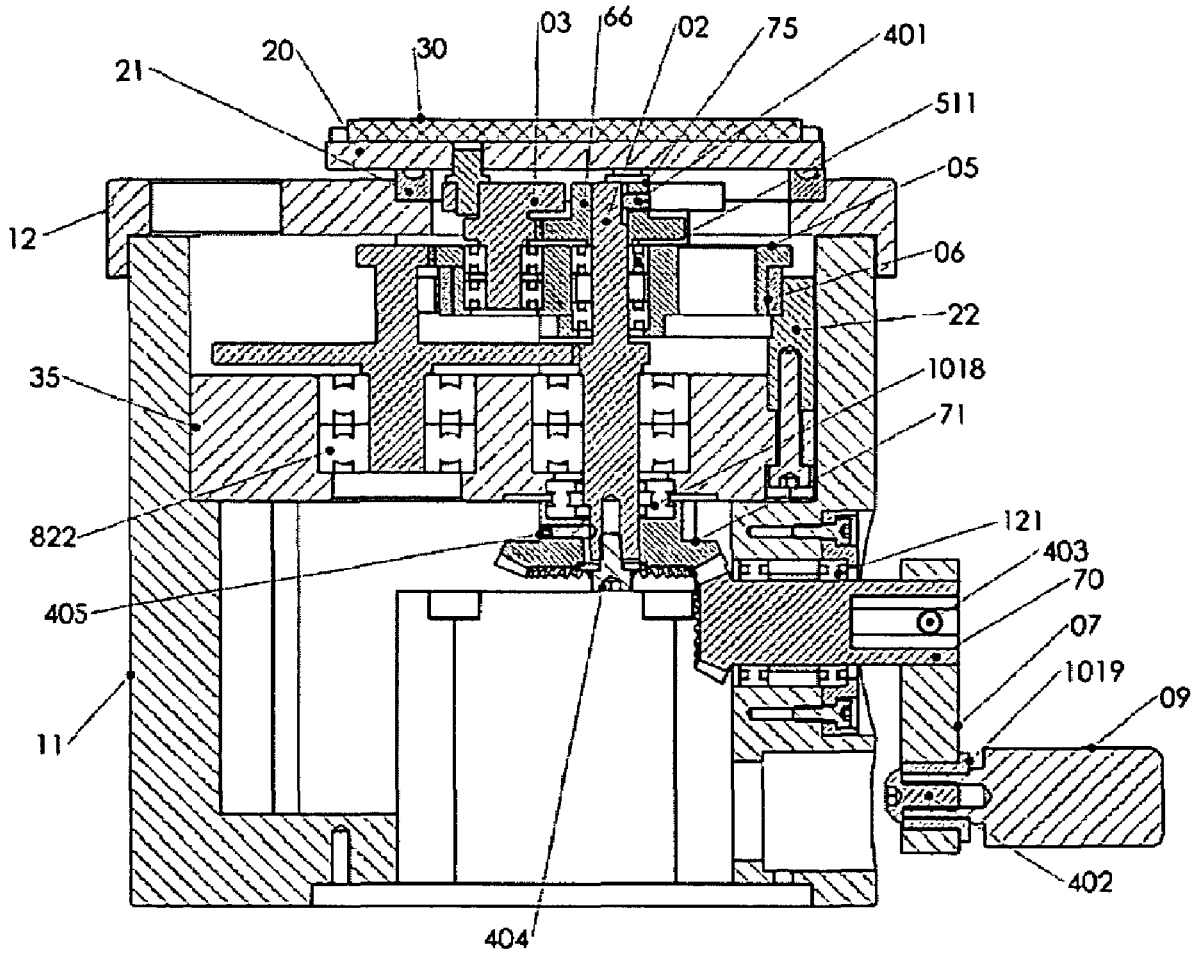
FIG. 4 is a cross section view of the manual polisher of the invention (fixture module and pressurizing module are not shown).

Referring to FIG. 2 and FIG. 3, the one DOF gear transmission system in the invention consists of the following components: shaft 02, shaft 72, eccentric link 031, eccentric link 032, eccentric link 033, shaft 361, shaft 362, shaft 363, rotator 66, carrier 05, bearing 06, bearing 511, bearing 512, bearing 513, bearing 822, bearing 823, turntable 20, holder 22, holder 35, set screw 401, and screw 402, where, rotator 66 being fixed with shaft 02 by set screw 401, holder 35 and holder 22 being fixed together by screw 402. There are six gears in this system: gear 906 on shaft 02, gear 905 on carrier, sun gear 904 on rotator 66, large gear 901 and small gear 902 on shaft 72. One end of shaft 361, 362, and 363 are fixed with the turntable 20 through the equally spaced holes 201,202, and 203 on the turntable respectively, while another end of shaft 361, 362, and 363 are forming a revolute joint at the eccentric hole 513, 514 (not shown), and 515 (not shown) on eccentric link 031, 032 and 033 respectively. The eccentric distance from the eccentric hole to the eccentric link axis can be expressed by a constant "R for all three eccentric links 031, 032 and 033. The eccentric link 031, 032 and 033 are forming a revolute joint 511, 516 (not shown), and 517 (not shown) with carrier 05 through three equally spaced holes 051, 052 and 053 respectively. But only eccentric link 031 is driven by sun gear 904. Theoretically, eccentric link 032 or 033 is redundant so that when calculating the DOF of the system, only one of them is considered.

From the kinematics point of view, this transmission system composes of six moving bodies, one frame (fixed body), seven revolute joints (lower pairs), and three pairs of gears engaging (higher pairs). And all the motions in this system are in a plane, or a couple of planes parallel one another. The definition of the degrees of freedom of a mechanism (or a mechanical system) is the number of independent relative motions among the rigid bodies. Based on Gruebler's equation, the degree-of-freedom for the said gear transmission system can be calculated as follows:

$$F=3(n-1)-2L-h$$

where,

F=total degrees of freedom in the system n=number of bodies (including the frame)

L=number of lower pairs (one degree of freedom)

h=number of higher pairs (two degrees of freedom)

As above mentioned, for the gear transmission system shown in FIG. 2 and FIG. 3, n=7, L=7, h=3, $$F=3\times(7-1)-2\times7-3=1$$

So the gear transmission system in this invention is one DOF mechanical system, i.e., the number of independent input motion must be one. For example, if a rotational motion is applied on shaft 02, the turntable 20 would perform a compound rotary-revolution motion, i.e., every point on the turntable 20 would make a synchronized rotation around its own rotating center with the rotating radius equal to the eccentric distance "R on eccentric link 031 and at the same time the turntable 20 also turns around its geometric axis. This compound rotary-revolution motion is one of the best for fiber optic polishing process.

Pressurizing Module

Figure 6:
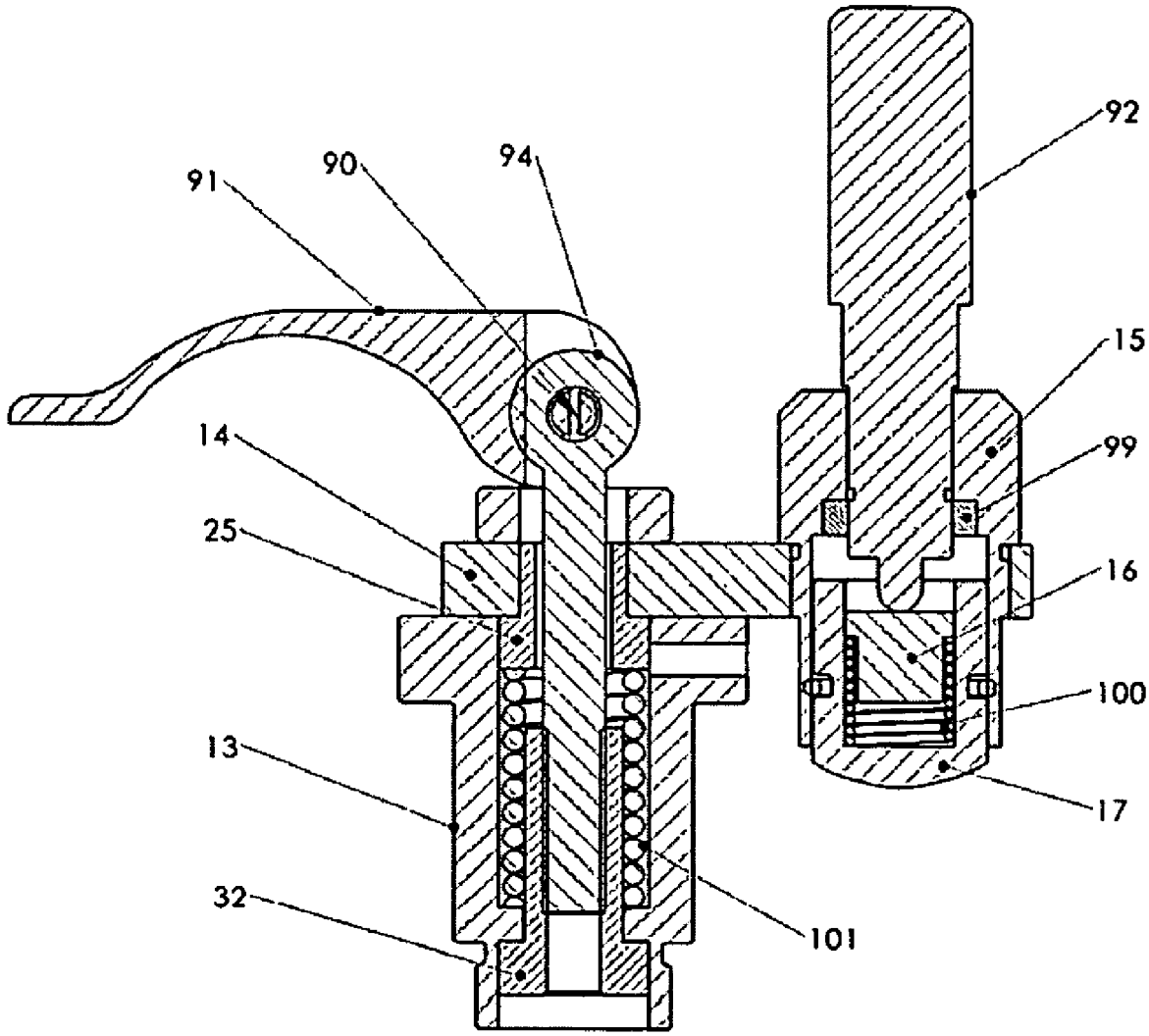
FIG. 6 is a cross section view of the pressurizing module of the polishers in the invention.

Polishing pressure is provided by the pressurizing module of the polishers in the invention. As shown in FIG. 6, pressure head 17 can be tuned up and down in the central hole of holder 15, which is fixed on the overarm 14. Spring 100 and plug 16 are mounted in the central hole above pressure head 17. The amount of polishing pressure is controlled by a micrometer 92, which is held on the top end of holder 15. By turning the micrometer 92, polishing pressure is adjusted through plug 16 and spring 100. The overarm is held on the top surface of plate 12 (FIG. 7) by a quick release mechanism which includes release handle 91, release screw 94, pin 90, nut 32, bush 25, spring 101 and holder 13. When release handle 91 is pulled up, the overarm 14 is able to rotate around bushing 25. When release handle 91 is pushed down, the overarm 14 is firmly held. That allows quick and convenient removed or placement of polishing fixture.

Fixture Module

Figure 7:
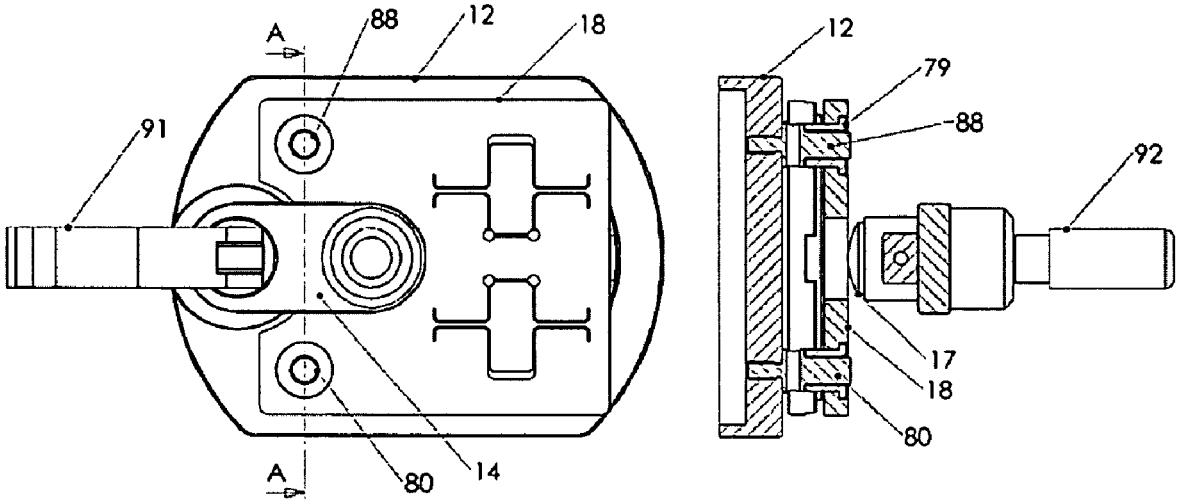
FIG. 7 shows the fixture module and pressurizing module of the polishers in the invention.

As shown in FIG. 7, a polishing fixture 18 is made of single metal plate with features cut out by wire EDM method for holding and releasing fiber ferrules or connectors during the polishing process.

Manual polisher

One of a preferred embodiment in this invention is the manual polisher as illustrated in FIG. 1, FIG. 4, FIG. 6 and FIG. 7. The one DOF gear transmission system described above in this invention is now used in the manual polisher shown in FIG. 4, where, the holder 35 is fixed in the housing 11. A rubber polishing pad 30 is placed on the top surface of turntable 20 and moves along with the turntable 20. A thrust bearing 21 is attached to plate 12 (plate 12 is fixed to housing 11 too) and is supposed to balance the pressure from polishing process. A bevel gear 71 is connected to shaft 02 by screw 404 and 405. The mating bevel gear 70 is mounted on housing 11 through a pair of bearing 121 and engaged with bevel gear 71. On the shaft end of gear 70, a crank 07 is attached by a screw 403. The crank handle 09 is forming a revolute joint with crank 07 through a bush 1019. So once a rotational motion is applied to crank 07, the bevel gear 70 drives the bevel gear 71 and the shaft 02. Through the one DOF gear transmission system described above, the turntable 20 performs a compound rotary-revolution motion.

Figure 1:
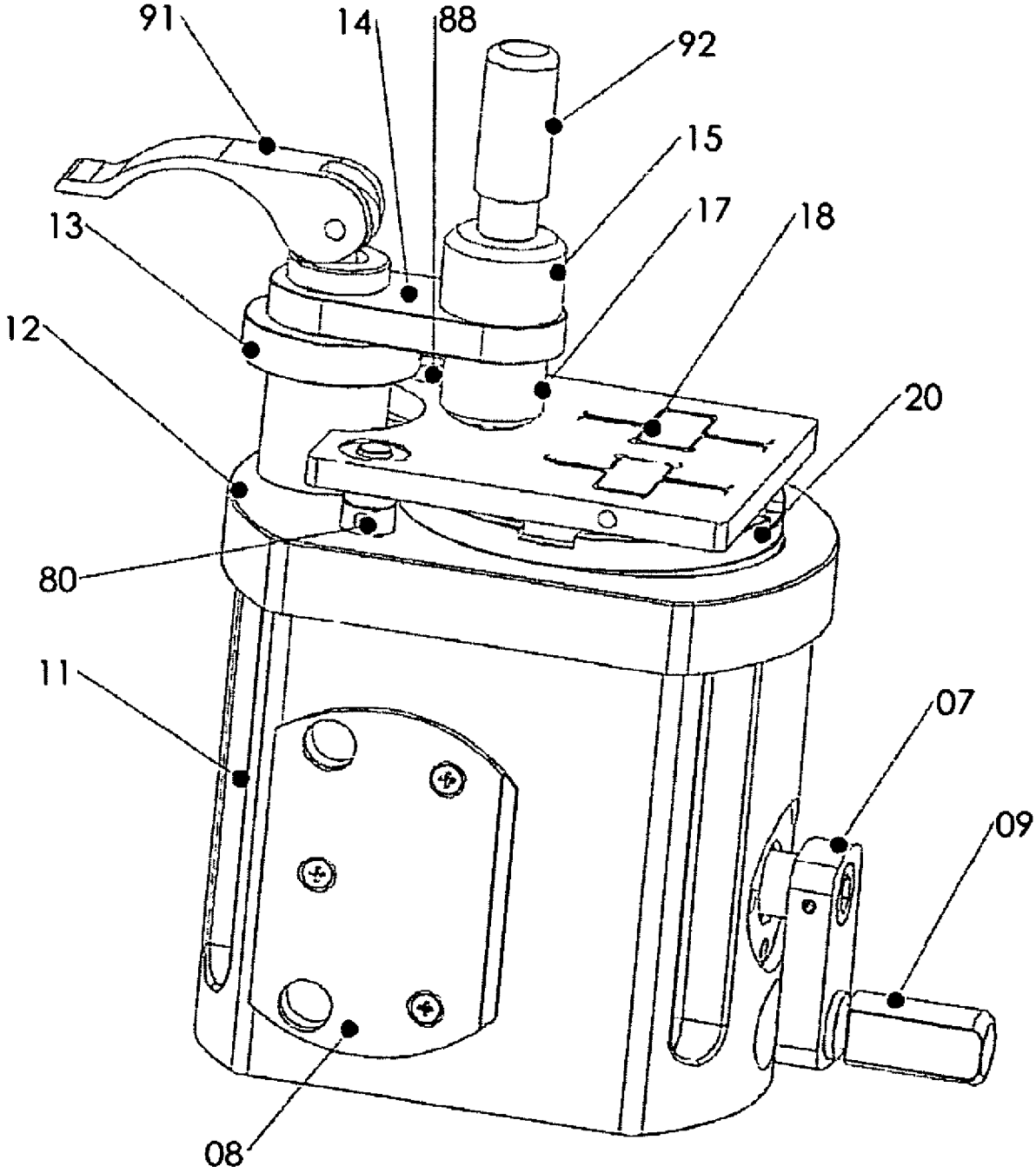
FIG. 1 is a 3D view of the manual polisher of the invention.

On the top surface of plate 12, there are the fixture module and pressurizing module as illustrated on FIG. 1. It allows the optic ferrule ends extending out of the bottom surface of fixture 18 during the polishing process. Fixture 18 sits on top of the rubber polisher pad 30 and is supported by a pair of pins 80 and 88 through bush 79. Pin 80 and 88 are screwed into the screw holes of plate 12 so that the fixture height can be adjusted (FIG. 7).

Polishing pressure is provided by adjusting the micrometer 92 to enable the pressure head 17 down to the top surface of fixture (FIG. 1). Reference plate 08 in FIG. 1 is used for multi-ferrule alignment before the polishing process when more than one ferrule, or connector polished.

Motorized Polisher

Figure 5:
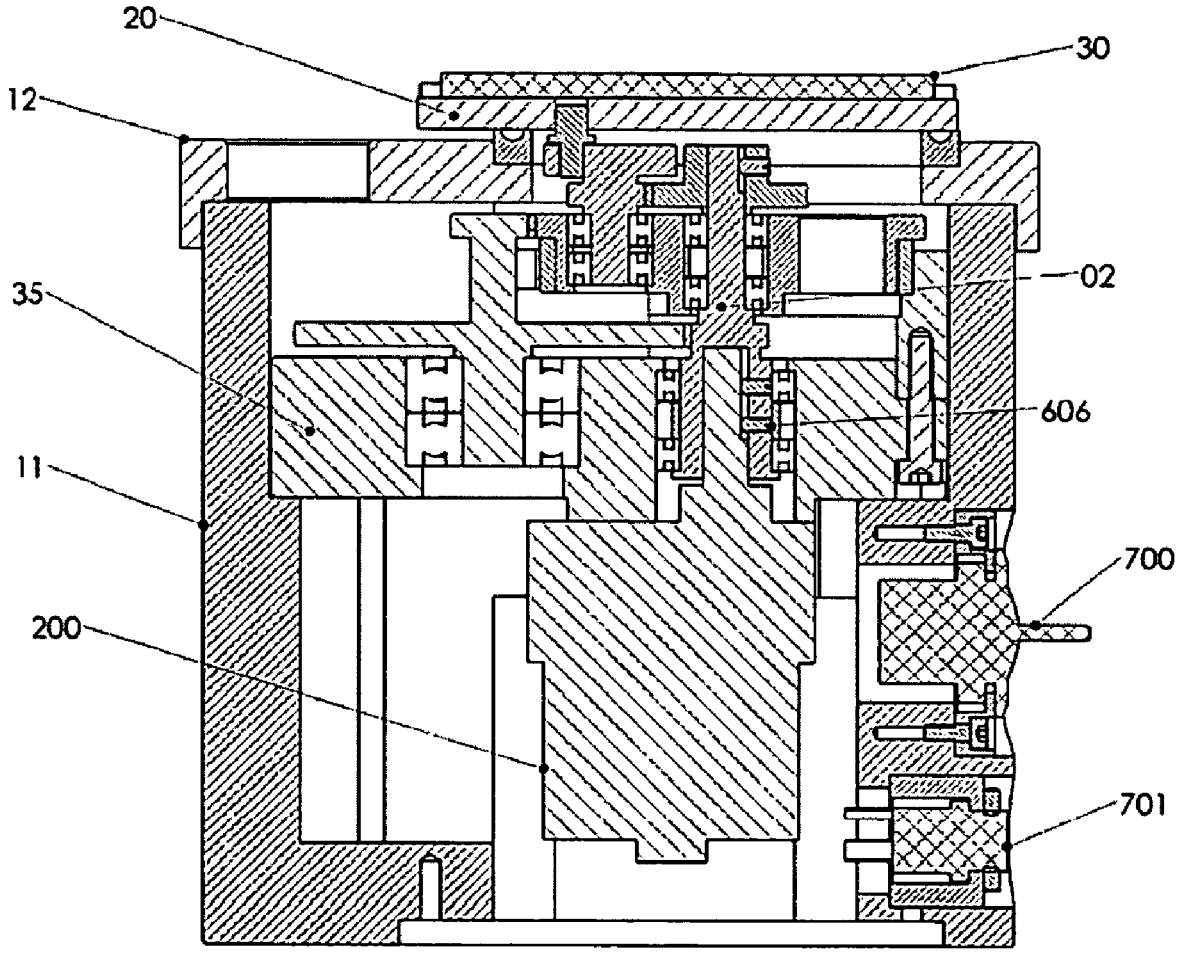
FIG. 5 is a cross section view of the motorized polisher of the invention (fixture module and pressurizing module are not shown).

Another preferred embodiment in this invention is the motorized polisher as illustrated in FIG. 5. Compared with the manual polisher in FIG. 4, the only difference is the bevel gears 70 and 71 as well as the crank-handle mechanism which are replaced by an electric motor 200. Motor 200 is mechanically secured with shaft 02 by screw 606 and electrically wired with power socket 701 and switch 700. By turning on power switch 700, motor 200 directly drives the one DOF gear transmission system described above.

The invention claimed is:

1. A fiber optic polisher having one-degree-of-freedom gear transmission system comprises:

a stationary base plate;

a compound drive shaft supporting a respective driving sun gear and a primary driving pinion on one side and having a drive portion on another side;

a primary planet shaft supporting an eccentric disc with an eccentric hole and supporting a planet gear interacting with said sun gear and each eccentric disk each having the same eccentricity amount;

two secondary planet shafts each supporting a respective eccentric disc with an eccentric hole;

a planetary carrier disposed in a rotatable combination with said compound drive shafts;

a compound gear shaft supporting a respective large gear and a secondary driving pinion;

wherein said planetary carrier has gear teeth, said compound drive shaft, its supported driving sun gear and a driving pinion is rotatable around its axis of rotation relative to said stationary base plate by said primary driving pinion engaging with said large gear, relative to said stationary base plate and said planetary carrier is rotatable around its axis of rotation by said secondary driving pinion engaging with said gear teeth on said carrier, relative to said stationary base plate, and said three planet shafts arranged on said planetary carrier at positions are equally spaced from said axis of rotation of said planetary carrier and are rotatable around its own axis of rotation relative to said carrier; and a turntable having three eccentric pins equally spaced from its axis of rotation, wherein said three eccentric pins of said turntable form three revolute joints with said three eccentric holes of said three planet shafts respectively.

2. The fiber optic polisher of claim 1 comprises:

a housing assembly having a machine housing with a cylindrical axis and a plurality of open spaces wherein a cover plate secured on the top of said machine housing along said cylindrical axis having a through hole perpendicular to the top surface of said cover plate, two screw holes perpendicular to the top surface of said cover plate on one side of said cover plate, and a thrust bearing seated and secured in the said through hole of said cover plate; and the desired shape of said machine housing modified from a cylinder with the aspect ratio about 1:1 so that the top, bottom, front and back surfaces are flat while the left and right surfaces bulge out.

3. The fiber optic polisher of claim 1 further comprises:

a fixture module having a polishing fixture made of single metal plate with features cut out by wife EDM method for holding and releasing fiber ferrules or connectors, and two pins each having thread on one side and a shoulder on the middle portion; wherein said polishing fixture has two pin holes on one side of said fixture that mate said two pins with said respective pin holes of said fixture and said fixture seating on the said shoulders of said pins.

4. The fiber optic polisher of claim 1 further comprises:

a pressurizing module comprising:

a micrometer with adjustable tip and scale;

a micrometer holder with a cylindrical shape;

a compression spring;

a spring plug with cap;

a pressure bead with a central blind hole and a bottom surface outside of the blind hole;

an overarm with the shape of beam;

a quick release mechanism;

said micrometer holder holding the said micrometer on upper portion of said holder and holding the said pressure head on lower portion of said holder and letting the said blind hole of said pressure head facing up;

said pressure head holding said spring with the said blind hole of said pressure head;

said spring plug inserted into the said compression spring and covering the said spring by the said cap of said spring plug;

said adjustable tip of said micrometer seating on the top of said cap of said spring plug;

said overarm holding the said micrometer holder on one side of said overarm and said quick release mechanism holding or releasing one side of said overarm very quick.

5. The fiber optic polisher of claim 1, wherein said stationary base plate of said gear transmission system is fixed inside of the open spaces of said housing assembly with any rotational axis of said gear transmission system parallel to the said cylindrical axis of said machine housing and the said turntable seating on top of said thrust bearing of said machine housing.

6. The fiber optic polisher of claim 1, wherein further comprising a polishing pad is held on the top surface of said turntable.

7. The fiber optic polisher of claim 3 wherein said fixture module is mounted on said top surface of said cover plate according, by said thread on said two pins of said polishing fixture mating with said respective screw holes on said cover plate, and the bottom surface of said polishing fixture touching with the top surface of said polishing pad.

8. The fiber optic manual polisher claim 4, wherein said pressurizing module is mounted on top surface of said cover plate with said bottom surface of said pressure head touching on the top surface of said polishing fixture.

9. The fiber optic polisher of claim 1, wherein further comprising a driven bevel gear is fixed on said drive portion of said compound drive shaft and engaged with said drive bevel gear mounted on said machine housing through a bearing; one of said through hole of said crank firmly holding the said drive shaft of said drive bevel gear and another said through hole of said crank forming a revolute joint with said pin of said crank handle.

10. The fiber optic polisher of claim 2, wherein said stationary base plate of said gear transmission system is fixed inside of said open spaces of said housing assembly with the rotational axis of said gear transmission system parallel to the said cylindrical axis of said machine housing and the said turntable seating on top of said thrust bearing of said machine housing.

11. The fiber optic polisher of claim 3, wherein said fixture module is mounted on top surface of said cover plate according, by said thread on said two pins of said polishing fixture mating with said respective screw holes on said cover plate, and the bottom surface of said polishing fixture touching with the top surface of said polishing pad.

12. The fiber optic polisher claim 4, wherein said pressurizing module is mounted on said top surface of said cover plate with said bottom surface of said pressure head touching on the top surface of said polishing fixture.

13. The fiber optic polisher of claim 1, further comprising:

an electric motor with stator and rotor; and said stator of said electric motor fixed on said stationary base plate and said rotor of said electric motor firmly connected with said drive portion of said compound drive shaft.

14. The fiber optic polisher of claim 2, further comprising:

an electric motor with stator and rotor; and said stator of said electric motor fixed on said stationary base plate and said rotor of said electric motor firmly connected with said drive portion of said compound drive shaft.

15. The fiber optic polisher of claim 3, further comprising:

an electric motor with stator and rotor; and said stator of said electric motor fixed on said stationary base plate and said rotor of said electric motor firmly connected with said drive portion of said compound drive shaft.

16. The fiber optic polisher of claim 4, further comprising:

an electric motor with stator and rotor; and said stator of said electric motor fixed on said stationary base plate and said rotor of said electric motor firmly connected with said drive portion of said compound drive shaft.

17. The fiber optic polisher of claim 5, further comprising:

an electric motor with stator and rotor; and said stator of said electric motor fixed on said stationary base plate and said rotor of said electric motor firmly connected with said drive portion of said compound drive shaft.

18. The fiber optic polisher of claim 6, further comprising:

an electric motor with stator and rotor; and said stator of said electric motor fixed on said stationary base plate and said rotor of said electric motor firmly connected with said drive portion of said compound drive shaft.

* * * * *